US009091090B1

(12) United States Patent
Kirby

(10) Patent No.: US 9,091,090 B1
(45) Date of Patent: Jul. 28, 2015

(54) BRACE FOR WALL WITH ADJUSTABLE MONITOR

(71) Applicant: Patrick C. Kirby, Columbus, OH (US)

(72) Inventor: Patrick C. Kirby, Columbus, OH (US)

( * ) Notice: Subject to any disclaimer, the term of this patent is extended or adjusted under 35 U.S.C. 154(b) by 0 days.

(21) Appl. No.: 14/580,359

(22) Filed: Dec. 23, 2014

Related U.S. Application Data

(62) Division of application No. 14/313,188, filed on Jun. 24, 2014, now Pat. No. 8,925,267.

(60) Provisional application No. 61/957,060, filed on Jun. 24, 2013.

(51) Int. Cl.
*E04G 23/02* (2006.01)
*E02D 37/00* (2006.01)

(52) U.S. Cl.
CPC ..... *E04G 23/0218* (2013.01); *E04G 23/0229* (2013.01); *E02D 37/00* (2013.01); *E02D 2600/10* (2013.01); *E02D 2600/20* (2013.01)

(58) Field of Classification Search
CPC ..... E04G 23/0218; E02D 37/00
USPC ..... 52/291, 573.1, 1, 126.4, 127.1, 127.2, 52/127.5, 289, 293.1, 293.2, 293.3, 167.1, 52/167.3, 167.4, 514; 33/1 H, 1 BB; 73/760, 855, 856; 248/351, 354.1, 248/354.3, 354.4, 357; 405/229, 272, 273, 405/274, 275, 276, 277, 278, 279, 280, 281, 405/282, 283, 284, 285, 286, 287
See application file for complete search history.

(56) References Cited

U.S. PATENT DOCUMENTS

| | | | |
|---|---|---|---|
| 3,341,995 | A | 9/1967 | Docken |
| 3,537,093 | A | 10/1970 | Perrett, III |
| 4,435,646 | A | 3/1984 | Coleman et al. |
| 4,472,883 | A | 9/1984 | Ortega |
| 5,048,243 | A | 9/1991 | Ward |
| 5,564,242 | A | 10/1996 | Larsen |
| 5,586,355 | A | 12/1996 | Metz et al. |
| 5,845,450 | A | 12/1998 | Larsen |
| 6,044,613 | A | 4/2000 | Crafts et al. |
| 6,357,190 | B1 | 3/2002 | Florentine |
| 6,662,505 | B2 | 12/2003 | Heady et al. |
| 7,117,648 | B1 | 10/2006 | Pryor |
| 7,419,335 | B1 | 9/2008 | Cohen |
| 7,478,508 | B2 | 1/2009 | Peterson |
| 7,681,367 | B2 | 3/2010 | Morton et al. |
| 7,726,093 | B2 | 6/2010 | Morton et al. |
| 7,861,469 | B2 | 1/2011 | Heady et al. |
| 8,136,317 | B1 | 3/2012 | McCown |
| 8,209,935 | B2 | 7/2012 | Heady et al. |
| 8,590,259 | B2 | 11/2013 | Trinko et al. |
| 8,925,267 | B1 * | 1/2015 | Kirby ..... 52/291 |

(Continued)

*Primary Examiner* — Rodney Mintz
(74) *Attorney, Agent, or Firm* — Standley Law Group LLP

(57) ABSTRACT

In a system for stabilizing a wall, especially a masonry wall (10), movement away from the wall of a rigid member (30) is prevented by a thrust rod (70) that is anchored to joists associated with the wall. The thrust rod acts on an unsecured upper end (32) of the rigid member and is adjustably received in a thrust bracket (60) affixed directly or indirectly to the joists. A warning collar (80) placed on the upper end is retained in place by the thrust rod, which normally bears against the upper end through an aperture in the warning collar. If the upper end retreats away from the thrust rod towards the wall by more than a predetermined distance, the warning collar slides down the rigid member, triggering a signal means (90).

7 Claims, 2 Drawing Sheets

(56) References Cited

U.S. PATENT DOCUMENTS

| | | | | |
|---|---|---|---|---|
| 2002/0062612 | A1 | 5/2002 | Heady et al. | |
| 2003/0131555 | A1 | 7/2003 | Heady et al. | |
| 2005/0138870 | A1 | 6/2005 | Ishimura et al. | |
| 2005/0204673 | A1 | 9/2005 | Reed | |
| 2007/0227082 | A1 | 10/2007 | Morton et al. | |
| 2009/0071085 | A1* | 3/2009 | Wheatley et al. | 52/291 |
| 2009/0071096 | A1 | 3/2009 | Morton et al. | |
| 2009/0193736 | A1 | 8/2009 | Halfon et al. | |
| 2010/0095603 | A1 | 4/2010 | DeFilipp | |
| 2012/0204512 | A1 | 8/2012 | Trinko et al. | |
| 2014/0360106 | A1* | 12/2014 | Sawyers | 52/127.2 |
| 2014/0361883 | A1* | 12/2014 | Ryan et al. | 340/436 |

* cited by examiner

BRACE FOR WALL WITH ADJUSTABLE MONITOR

CROSS-REFERENCE TO RELATED APPLICATIONS

This application is a divisional of U.S. Ser. No. 14/313,188, filed on 24 Jun. 2014, currently pending, which is in turn a non-provisional of U.S. 61/957,060, filed 24 Jun. 2013, to which a priority claim is made and which is incorporated by reference as if fully recited herein.

TECHNICAL FIELD

The disclosed embodiments of the present invention relate to a system for use in bracing a wall, particularly a basement wall, against a bowing force. The system is provided with a device for providing at least visual indication of a need to adjust the system

BACKGROUND

The inventive concept disclosed herein has direct application with a known technique of bracing a wall, such as is shown in U.S. Pat. No. 6,357,190 to Florentine or in U.S. Pat. No. 8,136,317 to McCown, among others. Each of the cited patents is incorporated by reference for teaching a method for bracing a wall, especially a masonry wall, and most especially one that is constructed below grade level and subjected to outside force bearing in on it. Such a wall is effectively stopped against movement at its lower end by a foundation. The upper end of the wall is also effectively stopped against movement by a joist structure having a plurality of joists that may run either parallel to or perpendicular to the wall. However, the presence of the lateral forces against the masonry wall, especially along an intermediate portion of the wall, can cause a bulging or bowing of the wall. This type of bulging or bowing is illustrated well in FIG. 1 of each of these cited patents. To counter this bulging or bowing force, it is known in the art to place a rigid member, particularly, an I-beam, against the wall and to secure the rigid member against either the wall or the floor at the lower end of the wall. When an I-beam is used as the rigid member, it is common to arrange the I-beam so that the face of one of its two flanges bears directly against the wall and the web that joins the two flanges is perpendicular to the wall. A variety of known means can be used to secure the lower end of the rigid member in place, as is again taught in the incorporated prior art. Notably, the rigid member is not secured at an upper end thereof to any structure. Instead, it is known to apply force against the rigid member from a base established by the joists. Typically, this force will be applied in an adjustable manner.

While these techniques are certainly useful in opposing the bulging forces imposed against sub-ground walls, especially masonry walls, will vary over time. If the inwardly-acting forces subside, the bulging of the wall may decrease, and the force being applied to the wall internally by the installed system will cease to be applied.

It is therefore an unmet advantage of the prior art to provide an indication to the user of such a system when the rigid member is no longer in contact with the applied force.

SUMMARY

This and other unmet advantages are provided by a system for monitoring the position of a rigid member used to brace a wall against bulging or bowing. The wall has a floor at a lower end thereof and a joist structure at an upper end thereof. The joists in the joist structure can run either parallel to or perpendicular to the wall being secured. The rigid member has a lower end that is secured from movement and an unsecured upper end. The system comprises a thrust bracket, a thrust rod and a warning collar.

The thrust bracket is adapted to be secured to the joist structure. In one embodiment, the thrust bracket is designed to be mounted to either a joist or to a header board affixed to at least two adjacent joists, thereby being useful in either type of joist structure. In another embodiment, the thrust bracket is directly attached to a pair or adjacent joists.

The thrust rod is adjustably received in the thrust bracket so that it is oriented to oppose movement of the upper end of the rigid member toward the thrust bracket beyond a predetermined distance.

The warning collar is slidingly received on the upper end of the rigid member, where it is normally retained on the upper end thereof by contact of the thrust rod with the upper end through an aperture in the warning collar. If the rigid member moves away from the thrust rod by at least a predetermined distance, the warning collar is no longer retained and slides down the rigid member.

The system can further comprise a signal means, in communication with the warning collar, such that the sliding of the warning collar along the rigid member actuates a switch of the signal means, resulting in a signal that can be visual, audible or electronic.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION OF A PREFERRED EMBODIMENT

Figure 1:
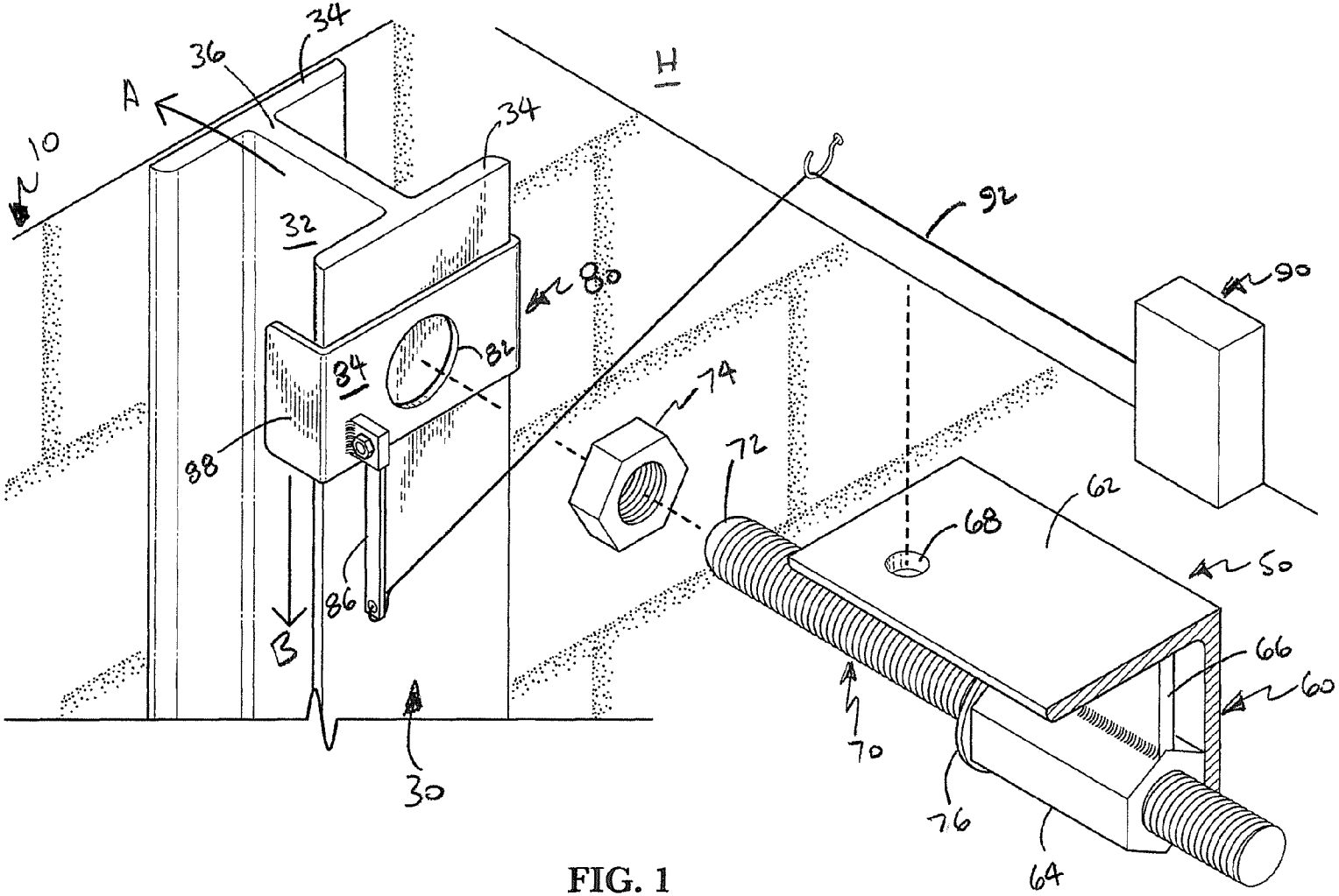
FIG. 1 is a perspective view of a first embodiment of the inventive concept, installed in a first manner.
Figures 2, 3, 4:
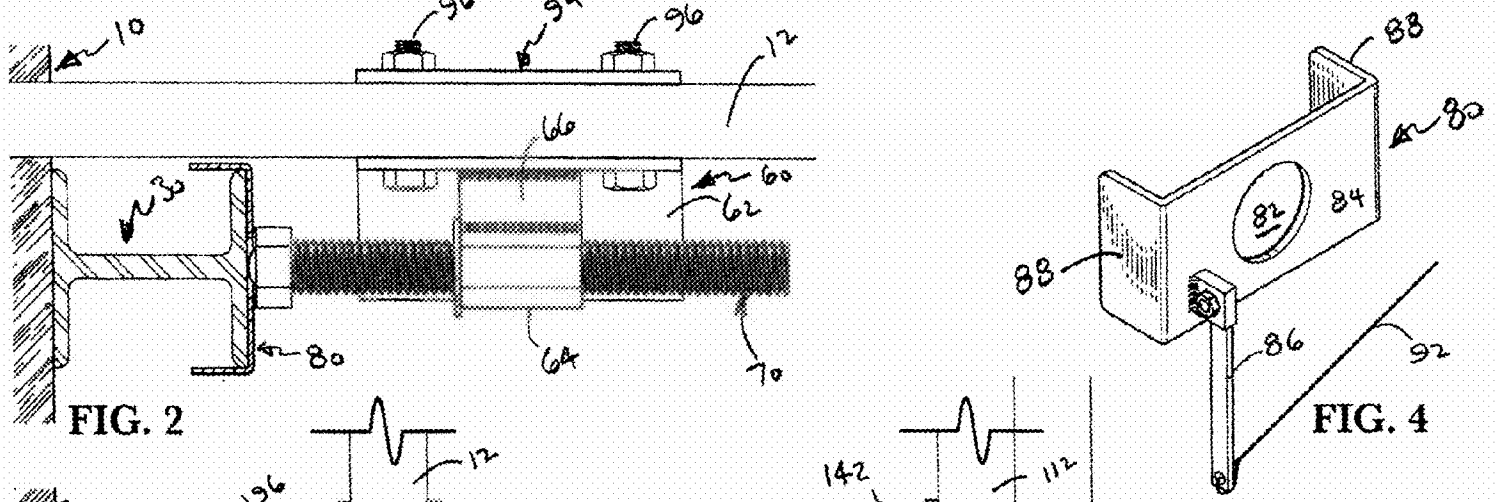
FIG. 2 is a top plan view of the FIG. 1 embodiment, installed in a second manner.
FIG. 3 is a top plan view of a second embodiment of the inventive concept, installed in the first manner.
FIG. 4 is a perspective view, in isolation, of a warning collar and drop rod of the inventive concept used with each of the FIG. 1 and FIG. 3 embodiments.

Because the general bracing technique in which the inventive concept is useful has been illustrated in the cited prior art, the accompanying drawings focus on the interactions occurring at the upper end of the rigid member. Specifically, FIG. 1 shows in perspective view how a first embodiment of an arrangement (shown in an exploded view) of the inventive concept is employed in a situation where the masonry wall 10 runs parallel to the joists, which are not illustrated in FIG. 1, to provide a better view of the operative parts. Also, the rigid member 30 is shown at only its upper end 32. This upper end 32 is unsecured to the joists, although (and as is shown in FIG. 3), the rigid member 30 can be secured to the wall 10 at one or more locations along the wall by clips. Rigid member 30 is depicted as an I-beam with flanges 34 that are joined by a web 36. One typical rigid member 30 used in this application would be a 4" by 4" by 13 lb/ft$^2$ steel I-beam, although different types of rigid member will be known to be useful in association with the inventive concept.

In the FIG. 1 arrangement, the joists can have a header board installed along a lower surface of the joists, perpendicular to the joists. Such a header board would be installed generally along line H in FIG. 1. A typical header board, when used, would be a nominal 2" by 8" board that would be affixed to the joists by lag bolts or the like.

The first embodiment 50 of the inventive concept can now be discussed. The embodiment generally has three parts: a thrust bracket 60, a thrust rod 70, which is received in the thrust bracket to resist movement with the upper end 32 of rigid member 30, and a warning collar 80, which fits on the rigid member 30 and is normally retained in place by contact between the thrust rod and a surface of flange 34. When the thrust rod 70 loses its contact with the rigid member 30 by more than a predetermined amount of distance, the warning collar 80 is no longer retained at the upper end 32 and is free to slide down the rigid member. This movement, in turn, is transmitted to a signal means, indicated generally by box 90 and an alarm is set off by tripping a switch associated with signal means. This action is generally depicted in FIG. 1 by arrows. When rigid member 30 moves as indicated by arrow A, distance arises between flange 32 and a tip end 72 of thrust rod 70, which also has a nut 74 threadingly received thereon. Normally, tip end 72 and nut 74 contact the flange 32 through an aperture 82 in warning collar 80. When the distance exceeds at least the thickness of plate 84 of the warning collar 80, the warning collar is able to slide down the in the direction of arrow B. As this occurs, the sliding action of the warning collar 80 imparts force to a tension member 92, which interacts with a switch on signal means 90, activating a signal, which can be visual, audible or even electronically transmitted, to a user remote from the installation. Of course, after the warning collar 80 has moved and activated the signal means, it is necessary to place the warning collar back into position and to retain it in place by advancing thrust rod 70 into engaging contact with flange 34. Note that movement of the rigid member 30 towards thrust rod 70, that is, movement that is opposite the direction of arrow A, does not activate the signal means 90.

A few additional features are shown in FIG. 1, particularly regarding the thrust bracket 60. In the depicted embodiment, thrust bracket 60 has an L-shaped member 62, preferably a piece of L-bar, with a length of nut 64 welded to one leg of the L-bar and affixed to the other leg by a piece of spacer bar 66 that is welded into place. The nut 64 is aligned to extend along the length of the L-shaped member 62. Each of the legs of the L-shaped member 62 is preferably provided with at least two holes 68 for bolting the thrust bracket 60 into position. In FIG. 1, the L-shaped member 62 is foreshortened, in order to allow easy viewing of the nut 64, but the actual thrust bracket 60 (especially as seen in FIG. 2) would have the L-shaped member extend further, effectively centering the nut 64 along its length. Bolts (not shown in FIG. 1) would secure the thrust bracket 60 to a bottom surface of a header board associated with (and spanning) a pair of adjacent joists. A thrust rod 70, depicted here as a length of 1" all-thread, is threadingly received in the length of nut 64 and extends from both ends thereof. A retention cup 76 is optionally used on the thrust rod 70, preferably on the same side of the nut 64 as the tip 72.

Two final features shown in FIG. 1 of the warning collar 80 are a drop rod 86 and a pair of wings 88. The drop rod 86 provides a site for affixing the tension member 92, so that the movement of the warning collar 80 effects action by the signal means 90. The wings 88 are provided to contour the warning collar 80 to the flange 34 in a manner that permits the warning collar to slide along the rigid member 30 but does not allow rotation of the warning collar thereon. The wings 88 can be provided in several ways, including welding plates to plate 84 or bending plate 84 into a U-shaped member. In some embodiments, it may be desirable to bend plate 84 more than 90 degrees in forming the wings 88, thereby providing a better fit to the flange 34. Material of the warning collar 80 is not considered to be of any particular import, although a steel plate is useful in that it provides mass for sliding down the flange 34 to effect the signal from signal means 90. By disengaging, the warning collar 80 provides immediate visual evidence of the movement of the thrust rod 70 relative to the rigid member 30. This indicates a need to advance the thrust rod 70 back into engagement with rigid member 30.

FIG. 2 shows in top view some exemplary aspects of a second situation in which the inventive concept may be used. In this view, rigid member 30 is seen in profile, as is the warning collar 80. This second situation of FIG. 2 differs from the first situation of FIG. 1 in that the joists 12, which were not seen in FIG. 1, are seen and run perpendicular to the wall 10 that will be reinforced. Because of this, one of the joists 12 provides a locus for anchoring the thrust bracket 60, which is identical to the thrust bracket taught in FIG. 1. Other than the different orientation of the joists 12, the overall situation is substantially the same as in FIG. 1.

As noted above, the full length of the L-shaped member 62 is shown in FIG. 2, providing a centering of the nut 64. Spacer bar 66 is also clearly seen in this view. A backing bar 94 is shown on the side of the joist 12 opposite the thrust bracket 60. This backing bar 94 is considered optional, but is desirable. Conventional fasteners, especially bolts 96, can be used to anchor the thrust bracket into place on joist 12. Thrust rod 70 is oriented identically relative to FIG. 1 and interacts identically with the rigid member 30 and the warning collar 80. To facilitate the understanding of the drawings, the drop rod and the signal means are not shown in FIG. 2, but they would be arranged as in FIG. 1. It would be understood that one of skill would recognize how to use backing bar 94, or an equivalent thereof, in anchoring the thrust bracket 70 in FIG. 1, although that is not shown.

FIG. 3 presents a second manner for using a thrust rod 70 and the warning collar 80 in a situation (as in FIG. 1) where adjacent joists 12, 112 are parallel to the wall 10 being stabilized. In this top view, the rigid member 30 is again seen in profile, as is the warning collar 80. Also, the drop rod and the signal means are not shown, their roles being clearly already established in other figures. A new feature shown in FIG. 3, but useful in any of the embodiments taught herein, is a retaining clip 98, which is shown retaining one of the flanges of rigid member 30 against the wall 10, using conventional masonry fasteners.

Most importantly, however, is the second embodiment 160 of the thrust bracket that is shown. Thrust rod 70 is oriented identically relative to FIG. 1 and interacts identically with the rigid member 30 and the warning collar 80. If thrust rod 70 differs in FIG. 3 from the other embodiments, it will be that it is longer, so that it can interact with the two joists 12, 112 that are involved in anchoring the thrust rod 70. At the first joist 12, a pair of thrust plates 162 are aligned on opposite sides of the joist and secured to the joist by fasteners, illustrated as bolts 196. Each thrust plate 162 has a nut 164 welded outside of an aperture 165, so that the thrust rod 70 is threadingly received in the respective nuts. At the next joist 112, a plate 140 is secured to the joist by conventional fasteners 142. Welded onto plate 140 is a length of pipe 144, with a diameter slightly larger than the diameter of the threaded thrust rod 70, so that the thrust rod is received in, but does not engage the inside of pipe 144. A nut 146 is threadingly received on thrust rod 70, but is not affixed to pipe 144. In this way, thrust rod 70 may be advanced toward warning collar 80, but the nut 146 prevents the thrust rod from being moved away from the warning collar, as it bears against a flanged end 148 of pipe 144.

FIG. 4 shows a perspective view of the warning collar 80 and the drop rod 86 in isolation, so that all features, especially both of the wings 88, are clearly visible. A short portion of tension member 92 is also seen.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A system for monitoring the position of a rigid member used to brace a wall against bulging or bowing, the wall having a floor at a lower end thereof and a joist structure at an upper end thereof, the rigid member having a lower end thereof secured from movement and an unsecured upper end, the system comprising:

a thrust bracket, comprising a first and a second plate, each plate having a central aperture with a nut welded around the central aperture, the first and second plates secured on opposite sides of a joist of the joist structure that runs parallel to the wall being braced with the respective central apertures and nuts aligned to threadingly receive a thrust rod;

the thrust rod, threadingly and adjustably received in the nuts of the respective first and second plates, the thrust rod opposing movement of the upper end of the rigid member toward the thrust bracket beyond a predetermined distance;

a warning collar, slidingly received on the upper end of the rigid member, the warning collar retained on the upper end by contact of the thrust rod with the upper end through an aperture in the warning collar, such that movement of the rigid member away from the thrust rod by at least the predetermined distance allows the warning collar to slide down the rigid member; and a signal means, in communication with the warning collar, such that the sliding of the warning collar along the rigid member actuates a switch of the signal means, resulting in a signal.

2. The system of claim 1, further comprising:

a third plate, adapted to be secured to a second joist adjacent to the joist to which the thrust bracket is secured, the third plate having a pipe extending therefrom and aligned to receive an end of the thrust rod.

3. The system of claim 2, further comprising:

a third nut, threadingly received on the thrust rod such that the third nut prevents movement of the thrust rod into the pipe beyond the predetermined distance.

4. The system of claim 1, wherein:

a tension member, attached to the warning collar, acts to communicate the signal means to the warning collar.

5. The system of claim 4, wherein:

a length of monofilament line acts as the tension member.

6. The system of claim 1, wherein:

the thrust bracket comprises an L-shaped member with a fourth nut affixed to a first leg of the L-shaped member and secured by a spacer to a second leg of the L-shaped member, the fourth nut sized and adapted for threadingly receiving the thrust rod.

7. The system of claim 6, wherein:

in a first orientation, the thrust bracket is adapted to be anchored to a header board secured to at least two adjacent joists of the joist structure where the joists run parallel to the wall being braced; and in a second orientation, the thrust bracket is adapted to be anchored to a joist of the joist structure where the joists run perpendicular to the wall being braced.

* * * * *